US008157361B2

(12) United States Patent
Turkenitz et al.

(10) Patent No.: US 8,157,361 B2
(45) Date of Patent: Apr. 17, 2012

(54) SELECTIVELY PURGING FLUID-JET PRINTHEAD OF PAGE-WIDE ARRAY FLUID-JET DEVICE

(75) Inventors: Chen Turkenitz, Azur (IL); Semion Gengrinovich, Ramat Gan (IL); Kobi Avitan, Netanya (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 200 days.

(21) Appl. No.: 12/348,304

(22) Filed: Jan. 4, 2009

(65) Prior Publication Data

US 2010/0171791 A1 Jul. 8, 2010

(51) Int. Cl.
*B41J 2/165* (2006.01)

(52) U.S. Cl. ..... 347/85

(58) Field of Classification Search ..... None
See application file for complete search history.

(56) References Cited

U.S. PATENT DOCUMENTS

| | | | | |
|---|---|---|---|---|
| 4,929,963 | A * | 5/1990 | Balazar | 347/89 |
| 5,367,326 | A | 11/1994 | Pond et al. | |
| 7,261,391 | B2 | 8/2007 | Van Gerven | |
| 7,284,819 | B2 | 10/2007 | Berry et al. | |
| 2006/0238587 | A1 * | 10/2006 | Horsnell et al. | 347/100 |
| 2007/0080984 | A1 | 4/2007 | Karppinen et al. | |
| 2007/0080994 | A1 | 4/2007 | Karppinen et al. | |
| 2007/0081018 | A1 | 4/2007 | Karppinen et al. | |
| 2007/0081019 | A1 | 4/2007 | Karppinen et al. | |
| 2007/0188542 | A1 | 8/2007 | Kanfoush et al. | |

* cited by examiner

*Primary Examiner* — Matthew Luu
*Assistant Examiner* — Alejandro Valencia

(57) ABSTRACT

An apparatus is to selectively purge a desired fluid-jet printhead of a number of fluid-jet printheads of a page-wide array fluid-jet device. The apparatus includes a purging insert movably locatable within a fluid channel of the page-wide array fluid-jet device. The fluid channel is to supply fluid to the fluid-jet printheads during normal operation of the page-wide array fluid-jet device. The apparatus includes a movement mechanism operatively coupled to the purging insert to move the purging insert within the fluid channel incident to the desired fluid-jet printhead. The apparatus includes a pressurizing mechanism fluidically coupled to the purging insert to pressurize fluid. The purging insert is to deliver the fluid as pressurized by the pressurizing mechanism to the desired fluid-jet printhead to purge the desired fluid-jet printhead.

15 Claims, 7 Drawing Sheets

SELECTIVELY PURGING FLUID-JET PRINTHEAD OF PAGE-WIDE ARRAY FLUID-JET DEVICE

BACKGROUND

One type of inkjet-printing device, which is more generally referred to as a fluid-jet device, is a page-wide array inkjet-printing device. In this type of inkjet-printing device, a number of inkjet printheads, which are more generally referred to as fluid-jet printheads, are organized as an array at least substantially perpendicular to the direction of movement of media sheets through the device. The array is a page-wide array in that the printheads extend from one side or edge of the media sheets to the other side or edge of the media sheets. As such, the array is typically stationary during printing; as media sheets are moved past the array, the printheads eject ink onto the media sheets.

A page-wide array inkjet-printing device thus contrasts with another type of inkjet-printing device known as a scanning printhead inkjet-printing device. In the latter type of inkjet-printing device, a scanning inkjet printhead moves, or scans, along a section, or swath, of a media sheet from one side to the other side of the sheet, ejecting ink along this media sheet section as it moves over the section. When printing on the current swath has finished, the media sheet is advanced slightly so that a new swath is incident to the printhead, and the printhead scans over the new swath. This process is repeated until ink has been printed on the media sheet as desired.

In general, page-wide array inkjet-printing devices are typically faster than scanning printhead inkjet-printing devices, in that a complete media sheet can have ink printed thereon in a desired manner more quickly using the former type of inkjet-printing device as compared to the latter type of inkjet-printing device. However, all inkjet-printing devices and other types of fluid-ejection devices are usually susceptible to occasional clogging of printhead nozzles through which ink is actually ejected. Therefore, a purging operation may have to be periodically performed to forcibly clear the printhead nozzles so that they can continue to be used for printing purposes.

DETAILED DESCRIPTION

Overview of Problem and Solution

Figure 1A:
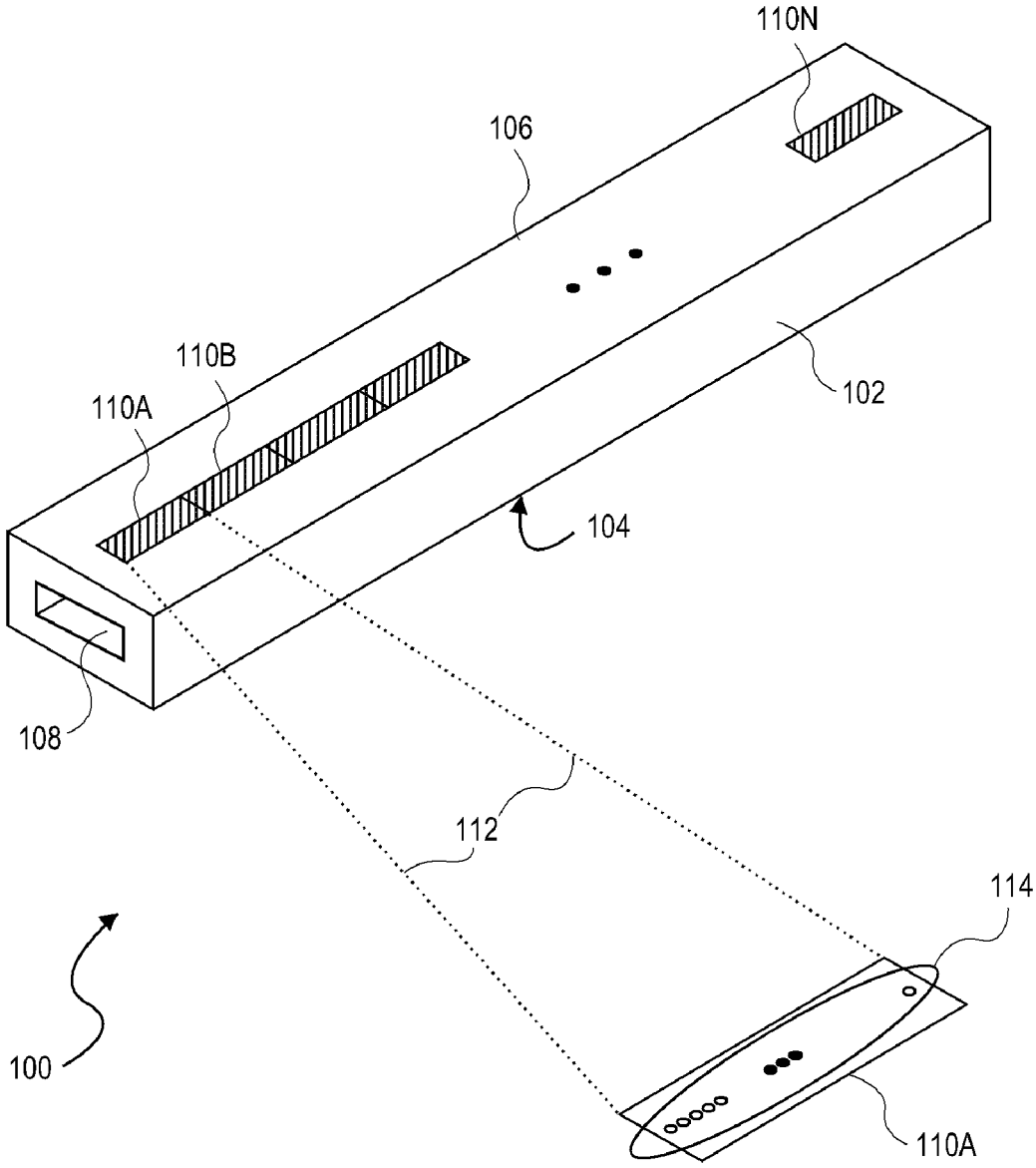
FIGS. 1A and 1B are diagrams of a page-wide array fluid-jet device, according to an embodiment of the present disclosure.

As has been noted in the background, fluid-jet printhead nozzles are susceptible to clogging. For instance, ink or other fluid may dry on the nozzles, plugging them up. As such, when the fluid-jet printhead of which these nozzles are a part is called upon to eject fluid, the printhead fails, because its nozzles are clogged. To clear the nozzles of such clogs, what is referred to as a purging operation is performed.

Purging can be generally achieved in a number of different ways. First, a wiping operation can be performed, in which a wiper or other type of wiping mechanism physically makes contact with and is moved back and forth over the clogged nozzles, removing the debris that is causing the clog. Second, a vacuuming operation can be performed, in which a vacuum or other type of suctioning mechanism is sealed around the clogged nozzles and turned on to vacuum or suction the debris that is causing the clog. Third, a purging operation can be performed in which fluid is forcibly ejected through the clogged nozzles to clear the debris that is causing the clog. In this type of purging, the fluid is ejected more forcibly than is achieved during normal ejecting operations to eject fluid in a desired manner, such as to print a desired image on a media sheet. This type of purging may be referred to as spitting.

Embodiments of the present disclosure are concerned with the latter type of purging, specifically in relation to page-wide array fluid-jet devices, such as page-wide array inkjet-printing devices. Forcibly ejecting fluid from page-wide array fluid-jet devices is typically difficult if not near impossible to accomplish without wasting significant amounts of fluid. This is because a page-wide array fluid-jet device has a relatively large number of fluid-jet printheads, and thus a relatively large number of fluid-jet nozzles. Purging all the nozzles of all the fluid-jet printheads may clear the nozzles that are clogged, but at the cost of wasting fluid by forcibly ejecting fluid through the nozzles of the typically larger in number printheads that are not clogged.

By comparison, forcibly ejecting fluid from a scanning head fluid-jet device, such as a scanning printhead inkjet-printing device, is relatively easy to achieve without wasting significant amounts of fluid. This is because there are relatively few printheads within such a scanning head fluid-jet device. Indeed, there may just be a single printhead within a scanning head fluid-jet device. Therefore, forcibly ejecting fluid through all the nozzles of all the fluid-jet printheads in this instance does not incur the cost of wasting significant fluid, because there are not that many printheads to begin with in a scanning head fluid-jet device.

Embodiments of the present disclosure overcome the disadvantages associated with forcibly ejecting fluid to purge clogged fluid-jet printheads of a page-wide array fluid-jet device by selectively purging the nozzles of just a given printhead of the device. As such, fluid is not wasted, because just a selected fluid-jet printhead has fluid forcibly ejected through its nozzles, and thus fluid is not forcibly ejected through the nozzles of all the fluid-jet printheads of a page-wide array fluid-jet device to clear the nozzles of just one printhead. As used herein, a clogged fluid-jet printhead refers to such a printhead that has one or more of its nozzles clogged. Furthermore, purging a given fluid-jet printhead refers to purging the nozzles of such a printhead.

Figure 1B:
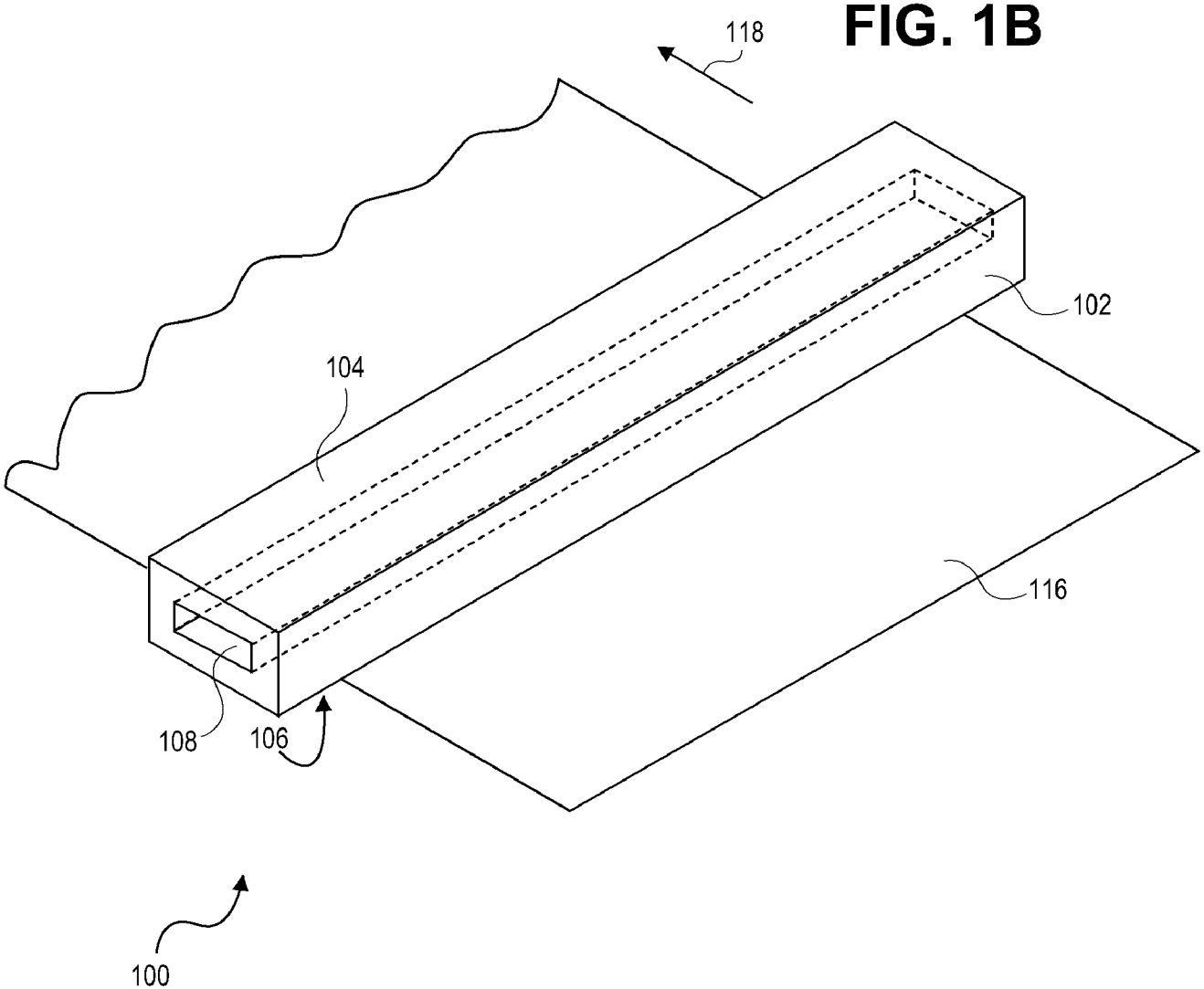

Basic Page-Wide Array Fluid-Jet Device and General Selective Purging Solution FIGS. 1A and 1B show a rudimentary page-wide array fluid-jet device 100, according to an embodiment of the present disclosure. The fluid-jet device 100 may be an inkjet-printing device, which is a device, such as a printer, that ejects ink onto media sheets, such as paper, to form images, which can include text, on the media sheets. The fluid-jet device 100 is more generally a fluid-jet precision-dispensing device that precisely dispenses fluid, such as ink. The fluid-jet device 100 may eject pigment-based ink, dye-based ink, another type of ink, or another type of fluid. Embodiments of the present disclosure can thus pertain to any type of fluid-jet precision-dispensing device that dispenses a substantially liquid fluid.

A fluid-jet precision-dispensing device is therefore a drop-on-demand device in which printing, or dispensing, of the substantially liquid fluid in question is achieved by precisely printing or dispensing in accurately specified locations, with or without making a particular image on that which is being printed or dispensed on. As such, a fluid-jet precision-dispensing device is in comparison to a continuous precision-dispensing device, in which a substantially liquid fluid is continuously dispensed therefrom. An example of a continuous precision-dispensing device is a continuous inkjet-printing device.

The fluid-jet precision-dispensing device precisely prints or dispenses a substantially liquid fluid in that the latter is not substantially or primarily composed of gases such as air. Examples of such substantially liquid fluids include inks in the case of inkjet-printing devices. Other examples of substantially liquid fluids include drugs, cellular products, organisms, fuel, and so on, which are not substantially or primarily composed of gases such as air and other types of gases, as can be appreciated by those of ordinary skill within the art.

The fluid-jet device 100 includes a frame 102 that nominally extends over the entire width of a media sheet 116. As such, the fluid-jet device 100 is specifically a page-wide array fluid-jet device, as opposed to a scanning head fluid-jet device like a scanning printhead inkjet-printing device as has been described above. The frame 102 has surfaces 104 and 106 opposite to one another. A fluid channel 108 extends within the frame 102 parallel to and between the surfaces 104 and 106.

A number of fluid-jet printheads 110A, 110B, . . . , 110N, collectively referred to as the fluid-jet printheads 110, are disposed on the surface 106 of the frame 102 of the fluid-jet device 100. The fluid-jet printheads 110 are positioned on the surface 106 so that the entire width of the media sheet 116 is covered by the printheads 110. Each of the fluid-jet printheads 110 includes a number of fluid-ejection nozzles. For instance, in FIG. 1A, the fluid-jet printhead 110A is depicted in exemplary detail as including a number of fluid-ejection nozzles 114.

In normal operation of the fluid-jet device 100, fluid such as ink is supplied to the fluid-jet printheads 110 via the fluid channel 108. The nozzles of the fluid-jet printheads 110 selectively eject fluid drops onto the media sheet 116 as the media sheet 116 moves past the frame 102 in a direction perpendicular to the frame 102, as indicated by the arrow 118. In this way, for instance, an image may be printed on the media sheet 116 using ink ejected by the printheads 110. Thus, typically the frame 102 and therefore the fluid-jet printheads 110 remain stationary during fluid ejection by the fluid-jet device 100. In this respect, the page-wide array fluid-jet device 100 is also distinguished from a scanning head fluid-jet device, in which a printhead is moved, or scanned, during fluid ejection by the device.

Figure 2:
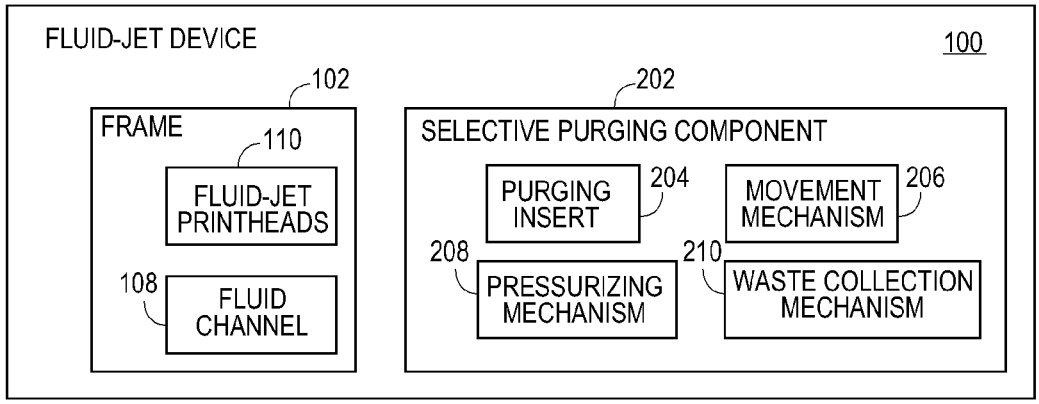
FIG. 2 is a block diagram of a page-wide array fluid-jet device having a selective purging component or apparatus, according to an embodiment of the present disclosure.

FIG. 2 shows a block diagram of the fluid-jet device 100, according to an embodiment of the present disclosure, in relation to which a general selective printhead purging solution is described. The fluid-jet device 100 in FIG. 2 is depicted as including the frame 102 having the fluid channel 108 and the fluid-jet printheads 110, as well as including a selective purging component, or apparatus, 202. The fluid-jet device 100 can and typically does include other components, in addition and/or in lieu of the frame 102, the printheads 110, and the selective purging component 202. For example, there can be more than one fluid channel 108, corresponding to the different colors of ink, for instance, where the fluid-jet device 100 is an inkjet-printing device.

The selective purging component 202 selectively purges a desired fluid-jet printhead of the fluid-jet printheads 110. As such, the selective purging component 202 is able to forcibly eject fluid through the fluid-ejection nozzles of a selected fluid-jet printhead, instead of through the fluid-ejection nozzles of all the fluid-jet printheads 110 of the fluid-jet device 100. The purging component 202 includes a purging insert 204, a movement mechanism 206, and a pressurizing mechanism 208, and may further include a waste collection mechanism 210. The insert 204 and the mechanisms 206, 208, and 210 are now described in a general manner. Thereafter, in subsequent sections of the detailed description, specific implementations embodying the selective purging component 202 are described.

The purging insert 204 is movably located within the fluid channel 108. The movement mechanism 206 is operatively coupled to the purging insert 204, and moves the purging insert 204 within the fluid channel 108 so that the purging insert 204 becomes incident to a desired fluid-jet printhead of the fluid-jet printheads 110 for purging purposes. The pressurizing mechanism 208 is fluidically coupled to the purging insert 204, and pressurizes fluid that is then delivered by the purging insert 204 to the desired fluid-jet printhead to purge this desired printhead.

In this manner, selective purging of just a desired fluid-jet printhead is achieved. Rather than forcibly ejecting fluid through all the fluid-jet printheads 110 of the fluid-jet device, fluid is forcibly ejected through just a desired fluid-jet printhead. This is accomplished by the movement mechanism 206 moving the purging insert 204 within the fluid channel 108 so that the insert 204 is incident to the desired printhead, and the pressurizing mechanism 208 pressurizing fluid that is then delivered by the insert 204 to the desired printhead for purging purposes. As noted above, specific embodiments of the insert 204 and the mechanisms 206 and 208 are described in subsequent sections of the detailed description.

It is further noted the waste collection mechanism 210 may also be movably disposed over the exterior of the fluid channel 108 (i.e., opposite the printheads 110 and below the surface 106 in FIG. 1B) to collect the waste resulting from purging of the printhead. Such waste typically includes the debris that is clogging the fluid-ejection nozzles of the fluid-jet printhead in question, and that is forcibly ejected from the nozzles during purging. The movement mechanism 206 in such instance can be operatively coupled to the waste collection mechanism 210 to also move the waste collection mechanism 210 over the exterior of the fluid channel 108 so that the mechanism 210 is incident to the fluid-jet printhead being purged.

First Specific Embodiment of Selective Purging Component or Apparatus

Figure 3A:
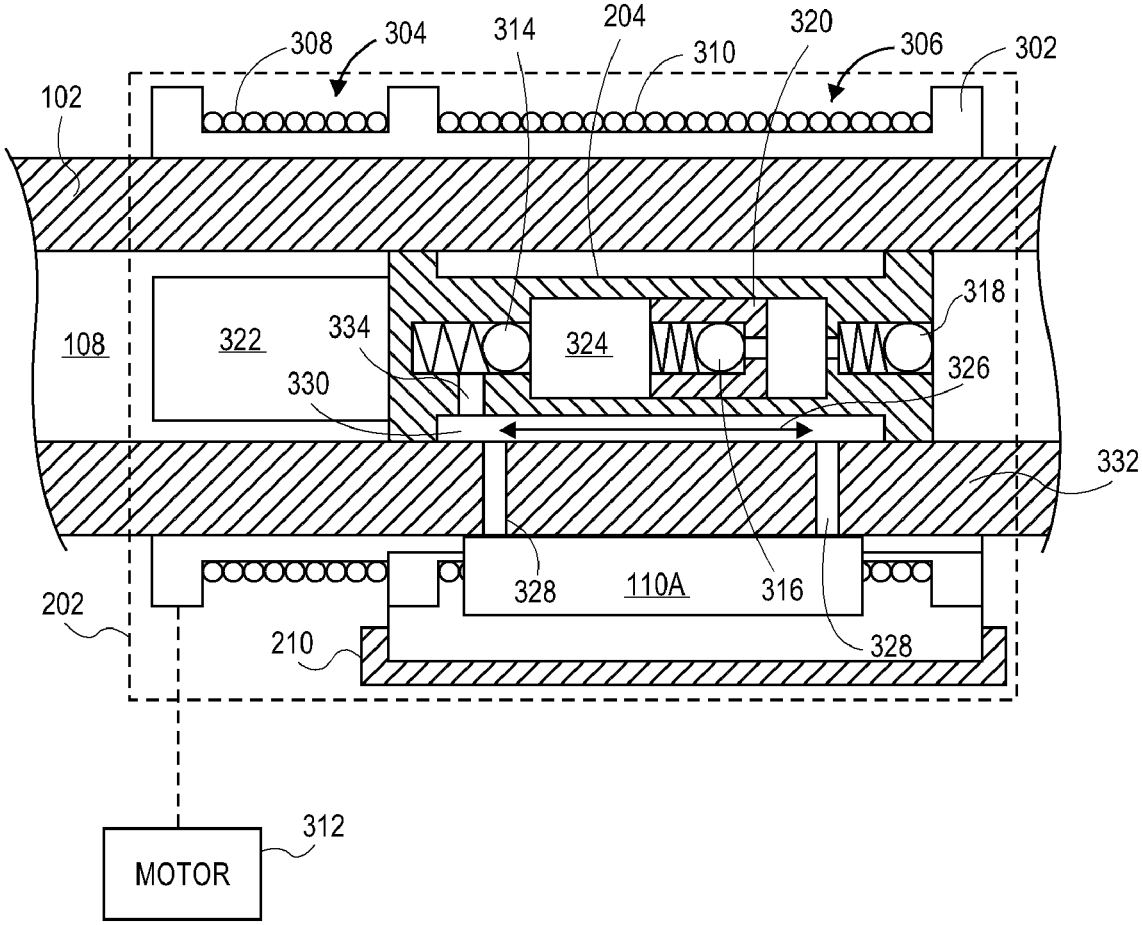
FIGS. 3A and 3B are a cross-sectional diagram and a perspective-view diagram, respectively, of a selective purging component or apparatus, according to an embodiment of the present disclosure.
Figure 3B:
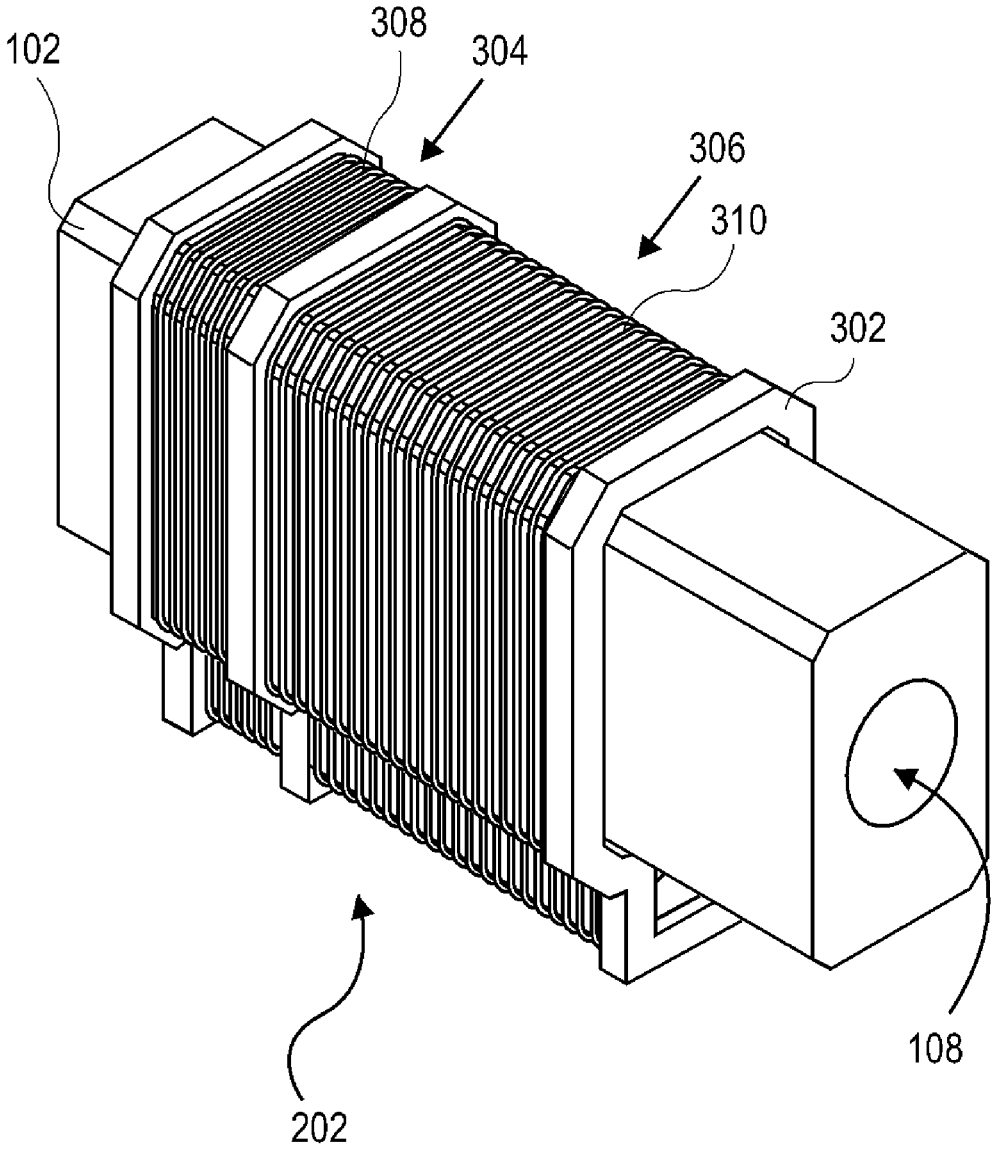

FIGS. 3A and 3B show a cross-sectional view and a perspective view, respectively, of the selective purging component 202, according to an embodiment of the disclosure. The selective purging component 202 includes the purging insert 204 that is movably locatable within the fluid channel 108 defined by the frame 102 of the fluid-jet device 100 that has been described. It is noted that the fluid channel 108 is depicted in FIG. 3B specifically as being round, whereas the fluid channel 108 has been depicted in FIGS. 1A and 1B as being rectangular for convenience.

The selective purging component 202 further includes the movement mechanism 206 of FIG. 2 as specifically encompassing a carriage section 304 of a carriage 302, a ferromagnetic member 322, and a direct current (DC) coil 308. It is noted, however, that the movement mechanism 206 is not specifically called out in FIGS. 3A and 3B apart from its constituent parts. The movement mechanism 206 may also include a motor 312. The selective purging component 202 further includes the pressurizing mechanism 208 of FIG. 2 as specifically encompassing a cavity 324, inlet valves 316 and 318, a piston 320, an outlet valve 314, a carriage section 306 of the carriage 302, and an alternating current (AC) coil 310. Here, too, it is noted that the pressurizing mechanism 208 is not specifically called out in FIGS. 3A and 3B apart from its constituent parts. The selective purging component 202 may also include the waste collection mechanism 210.

With respect to the movement mechanism 206, the carriage section 304 is movably disposed on the exterior of the fluid channel 108 (i.e., on the frame 102). That is, the carriage 302, including the carriage section 304 of the movement mechanism 206 and the carriage section 306 of the pressurizing mechanism 208, is movable along the frame 102. The ferromagnetic member 322 is attached to the purging insert 204 and is movably disposed within the fluid channel 108 incident to the carriage section 304. The DC coil 308 is wound around the carriage section 304.

Upon powering of the DC coil 308 using a DC power source (not depicted in FIGS. 3A and 3B), the DC coil 308 becomes inductively coupled to the ferromagnetic member 322. As such, movement of the carriage 302 and thus the carriage section 304 over the exterior of the fluid channel 108 (i.e., over the frame 102) causes corresponding movement of the ferromagnetic member 322 and thus the purging insert 204 within the fluid channel 108. The carriage 302 may be manually moved in this respect, or the motor 312 may be used in one embodiment.

With respect to the pressurizing mechanism 208, the inlet valves 316 and 318 fluidically couple the fluid channel 108 to or with the cavity 324 to move fluid from the fluid channel 108 to the cavity 324. The piston 320 pressurizes the fluid within the cavity 324. The outlet valve 314 fluidically couples the cavity 324 to the desired fluid-jet printhead 110A to move the fluid as pressurized within the cavity 324 to the printhead 110A. The carriage section 306 of the carriage 302 is movably disposed on the exterior of the fluid channel 108 (i.e., on the frame 102). The AC coil 310 is wound around the carriage section 306, and is electromagnetically coupled to the piston 320. The piston 320 pressurizes the fluid within the cavity 324 generally as follows. Upon powering of the AC coil 310 using an AC power source (not depicted in FIGS. 3A and 3B), the piston 320 oscillates within the cavity 324 due to its being electromagnetically coupled to the AC coil 310, as indicated by the bidirectional arrow 326, to pressurize the fluid within the cavity 324.

More specifically, in particular relation to FIG. 3A, when the piston 320 moves to the right, the inlet valves 316 and 318 open to permit the fluid within the fluid channel 108 to enter the cavity 324. When the piston 320 moves to the left, the inlet valves 316 and 318 close and the fluid within the cavity 324 is pressurized. Alternatively, the inlet valves 316 and 318 may be one-way valves that permit fluid to travel just from the fluid channel to the cavity 324, and remain open while the piston 320 moves to the left and to the right. During pressurization, the outlet valve 314 remains closed. Once the fluid within the cavity 324 has been pressurized, the outlet valve 314 is opened.

With respect to the purging insert 204, the purging insert 204 includes a cavity 330 that is fluidically coupled to the outlet valve 314. The terminology fluidically coupled means the following. When a first element is said to be fluidically coupled to a second element, this means that fluid is permitted to flow from the first element to the second element. When a third element is said to fluidically couple a first element with a second element, this means that the third element permits fluid to flow from the first element to the second element.

It is noted that the fluid channel 108 is separated from the desired fluid-jet printhead 110A by a wall 332 of the frame 102. The wall 332 includes one or more secondary channels 328 that fluidically couple the fluid channel 108 to the desired fluid-jet printhead 110A. Thus, the movement mechanism 206 moves the purging insert 204 within the fluid channel 108 so that the insert 204 is incident to the desired fluid-jet printhead 110A. As such, the cavity 330 of the purging insert 204 is fluidically coupled to the desired fluid-jet printhead 110A via the secondary channels 328.

Therefore, after the movement mechanism 206 has appropriately moved the purging insert 204 and the pressurizing mechanism 208 has pressurized fluid within the cavity 324, opening of the outlet valve 314 causes the pressurized fluid to be released to the cavity 330 through a secondary channel 334, and thus to the fluid-jet printhead 110A through the secondary channels 328. Because the fluid is pressurized, it causes any debris clogging the fluid-jet nozzles of the fluid-jet printhead 110A to be forcibly removed into the waste collection mechanism 210. In this way, the selective purging component 202 of FIGS. 3A and 3B purges just the desired fluid-jet printhead 110A.

As has been noted above, the waste collection mechanism 210 collects waste resulting from purging of the fluid-jet printhead 110A. In this respect, the movement mechanism 206 is operatively coupled to the waste collection mechanism 210 to move the mechanism 210 over the exterior of the fluid channel 108 (i.e., over the frame 102) so that the mechanism 210 is incident to desired fluid-jet printhead 110A. The waste collection mechanism 210 is attached to the carriage section 306 of the carriage 302, and therefore is incident to and specifically below the fluid-jet printhead 110A when the purging insert 204 is incident to and specifically above the printhead 110A.

In summary, then, the movement mechanism 206 of FIGS. 3A and 3B moves the purging insert 204 so that it is incident to the desired fluid-jet printhead 110A. This is achieved by powering the DC coil 308 wound around the carriage section 304 so that the ferromagnetic member 322 that is attached to the purging insert 204 is inductively coupled to the DC coil 308. Thus, subsequent movement of the carriage 302, either manually or by the motor 312, over the frame 102 results in corresponding movement of the purging insert within the fluid channel 108.

Once the purging insert 204 has been moved incident to the desired fluid-jet printhead 110A, the AC coil 310 wound around the carriage section 306 is powered to oscillate the piston 320. Fluid moving from the fluid channel 108 to the cavity 324 via the inlet valves 316 and 318 is pressurized by the piston 320 within the cavity 324. Once the fluid within the cavity 324 has been pressurized, the outlet valve 314 is opened, and the pressurized fluid travels to and is forcibly ejected by the fluid-jet printhead 110A to purge the printhead 110A. Waste, such as the debris that was clogging the fluid-jet printhead 110A and the fluid used to purge the printhead 110A, is collected by the waste collection mechanism 210.

It is noted that in the embodiment of FIGS. 3A and 3B, the movement mechanism 206 is operably coupled to the purging insert 204, in that operation (i.e., movement) of the movement mechanism 206 results in movement of the purging insert 204. The movement mechanism 206 is physically coupled to the purging insert 204 in that the ferromagnetic member 322 is attached to the insert 204. Furthermore, in the embodiment of FIGS. 3A and 3B, the pressurizing mechanism 208 is partially disposed within the purging insert 204. That is, the cavity 324, the inlet valves 316 and 318, the piston 320, and the outlet valve 314 of the pressurizing mechanism 208 are all disposed within the purging insert 204. By comparison, the carriage section 306 of the carriage 302 and the AC coil 310 of the pressurizing mechanism 208 are not disposed within the purging insert 204.

Second Specific Embodiment of Selective Purging Component or Apparatus

Figure 4A:
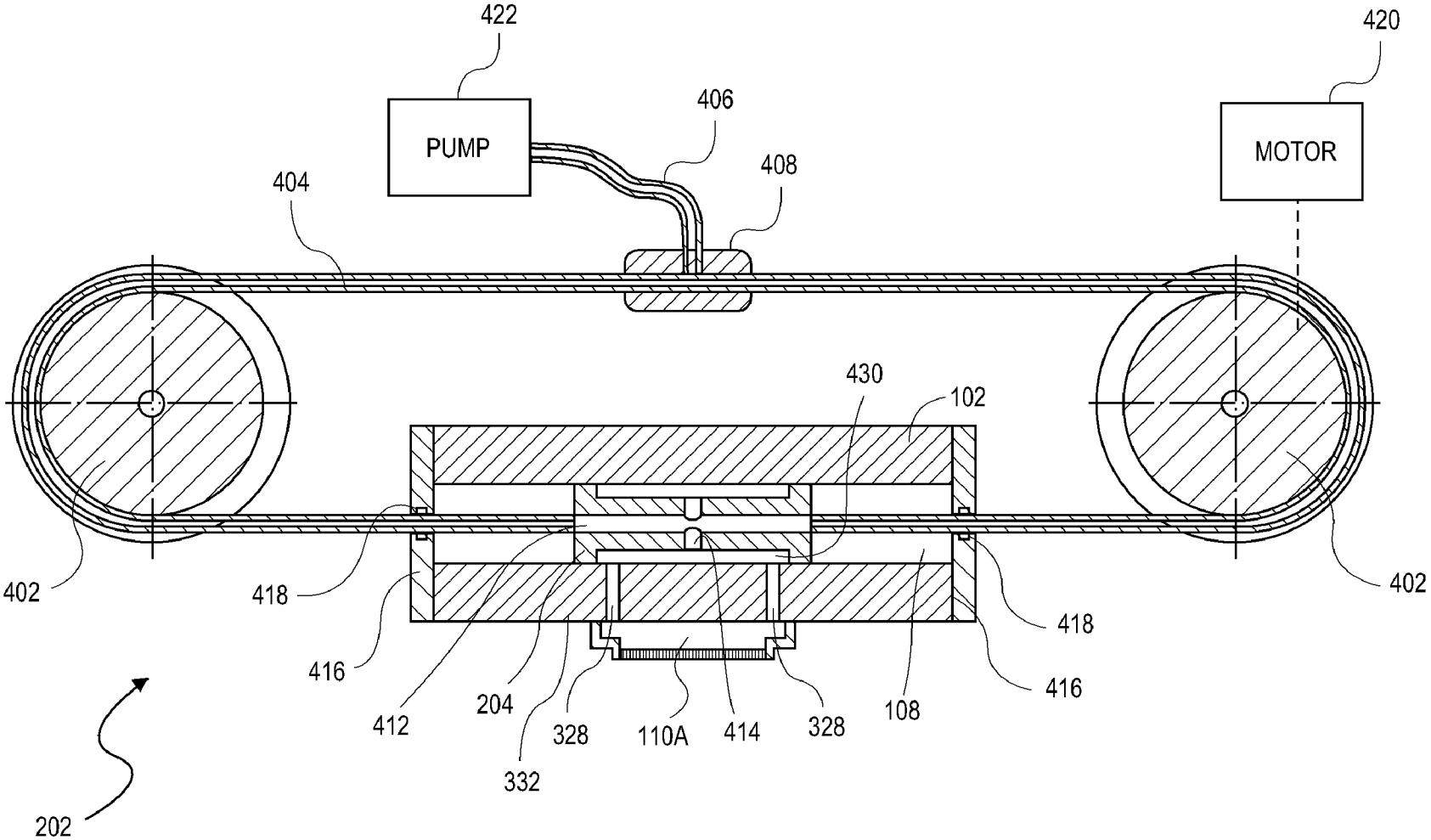
FIGS. 4A and 4B are a cross-sectional diagram and a perspective-view diagram, respectively, of a selective purging component or apparatus, according to an embodiment of the present disclosure.
Figure 4B:
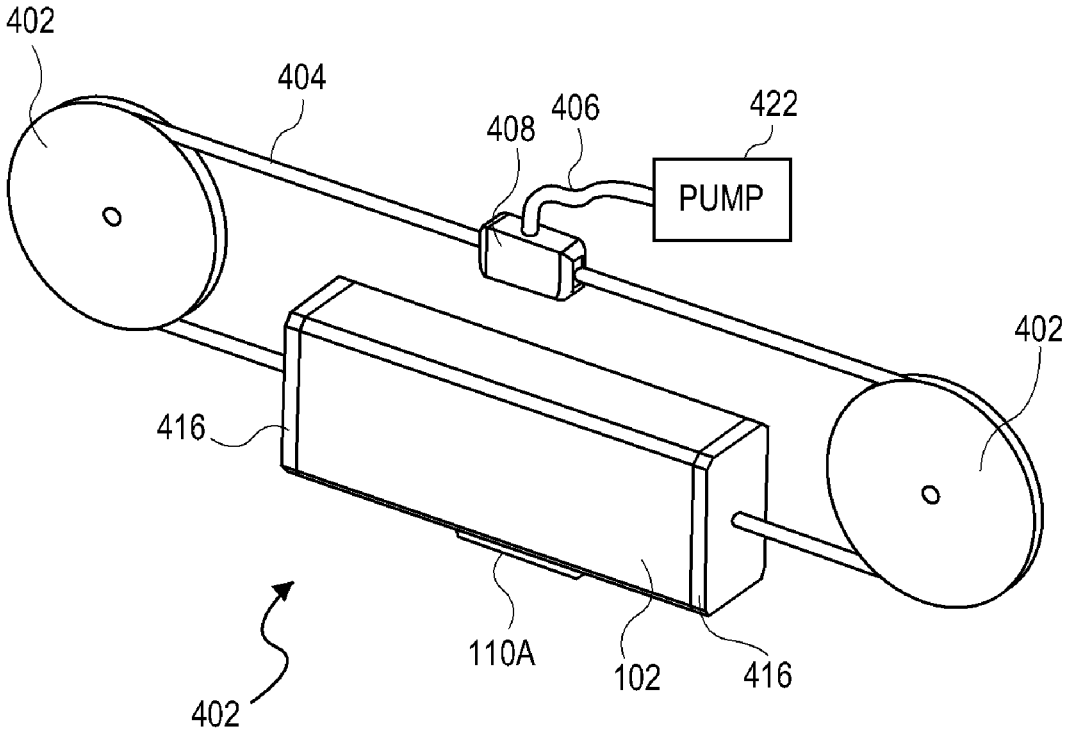

FIGS. 4A and 4B show a cross-sectional view and a perspective view, respectively, of the selective purging component 202, according to another embodiment of the disclosure. The selective purging component 202 includes the purging insert 204 that is movably locatable within the fluid channel 108 defined by the frame 102 of the fluid-jet device 100 that has been described. The selective purging component 202 further includes the movement mechanism 206 of FIG. 2 as specifically encompassing rotatable pulley wheels 402 and flexible hollow tubing 404, and which also may include a motor 420. It is noted that the movement mechanism 206 is not specifically called out in FIGS. 4A and 4B apart from its constituent parts, however.

The selective purging component 202 also includes the pressurizing mechanism 208 of FIG. 2 as specifically encompassing a pump 422, and flexible hollow tubing 406. Here, again, the pressurizing mechanism 208 is not specifically called out in FIGS. 4A and 4B apart from its constituent components. The selective purging component 202 may include the waste collection mechanism 210 that has been described, but it is not shown in FIGS. 4A and 4B.

With respect to the movement mechanism 206, the flexible hollow tubing 404 is disposed around the rotatable pulley wheels 402 and is fixably attached to and fluidically coupled to the purging insert 204 within the fluid channel 108. Rotation of the rotatable pulley wheels 402 causes the flexible hollow tubing 404 disposed around the pulley wheels 402 to move, which results in movement of the purging insert within the fluid channel 108. In this respect, the flexible hollow tubing 404 serves as a pulley belt. The pulley wheels 402 may be manually rotated, or may be rotated using the motor 420. It is noted in FIGS. 4A and 4B, the frame 102 is depicted as being relatively short for illustrative clarity and convenience. Furthermore, the frame 102 has on either end a sealing flange 416 that fluidically seals the ink channel 108 around a passage 418 through which the flexible hollow tubing 404 passes.

With respect to the movement mechanism 206, the flexible hollow tubing 406 is fluidically couples the pump 422 with the purging insert 204 via the fluidic coupler 408 fluidically coupling the flexible hollowing tube 406 to the flexible hollow tubing 404. When the rotatable pulley wheels 402 are rotated to move the flexible hollow tubing 404, the fluidic coupler 408 correspondingly moves as well. The pump 422 pressurizes the fluid, and the pressurized fluid is delivered from the pump 422 to the purging insert 204 via the flexible hollow tubings 406 and 404.

With respect to the purging insert 204, the purging insert again includes the cavity 330 that has been described, and also includes a cavity 412 and one or more secondary channels 414. The fluid channel 108 is also again separated from the desired fluid-jet printhead 110A by the wall 332 of the frame 102, where the wall includes the secondary channels 328 that fluidically coupled the fluid channel 108 to the desired fluid-jet printhead 110A. The secondary channels 414 fluidically coupling the cavity 412 of the purging insert 204 to the cavity 330 of the insert 204. The cavity 412 of the purging insert 204 is itself fluidically coupled to the flexible hollow tubing 404. Thus, the movement mechanism 206 moves the purging insert 204 within the fluid channel 108 so that the insert 204 is incident to the desired fluid-jet printhead 110A. As such, the cavity 330 of the purging insert 204 is resultantly fluidically coupled to the desired printhead 110A via the secondary channels 328.

Therefore, after the movement mechanism 206 has appropriately moved the purging insert 204 and the pressurizing mechanism 208 has pressurized fluid, the pressurized fluid is delivered via the flexible hollow tubings 406 and 404 to the cavity 412 of the purging insert 204. From the cavity 412, the pressurized fluid travels through the secondary channels 414 to the cavity 330 of the purging 204, from which the pressurized fluid travels to the fluid-jet printhead 110A via the secondary channels 328. Because the fluid is pressurized, it causes any debris clogging the fluid-jet nozzles of the fluid-jet printhead 110A to be forcibly removed, and into the waste collection mechanism 210 if present. In this way, the selective purging component 202 of FIGS. 4A and 4B purges just the desired fluid-jet printhead 110A.

In summary, then, the movement mechanism 206 of FIGS. 4A and 4B moves the purging insert 204 so that it is incident to the desired fluid-jet printhead 110A. The pump 422 pressurizes fluid, which travels via the flexible hollow tubings 406 and 404 to the purging insert 204. Via the cavities 412 and 330 and the secondary channels 414 and 328, the pressurized fluid travels to and is forcibly ejected by the fluid-jet printhead 110A to purge the printhead 110A.

It is noted that in the embodiment of FIGS. 4A and 4B, the movement mechanism 206 is operably coupled to the purging insert 204, in that operation of the movement mechanism 206 results in movement of the purging insert 204. The movement mechanism 206 is physically and fluidically coupled to the purging insert 204 in that the flexible hollow tubing 404 is physically and fluidically attached to the insert 204. Furthermore, in the embodiment of FIGS. 4A and 4B, no part of the pressurizing mechanism 208 is disposed within the purging insert 204. For instance, the pump 422, the flexible hollow tubing 406, and the fluidic coupler 408 are all disposed outside the purging insert 204.

Concluding Method of Use

Figure 5:
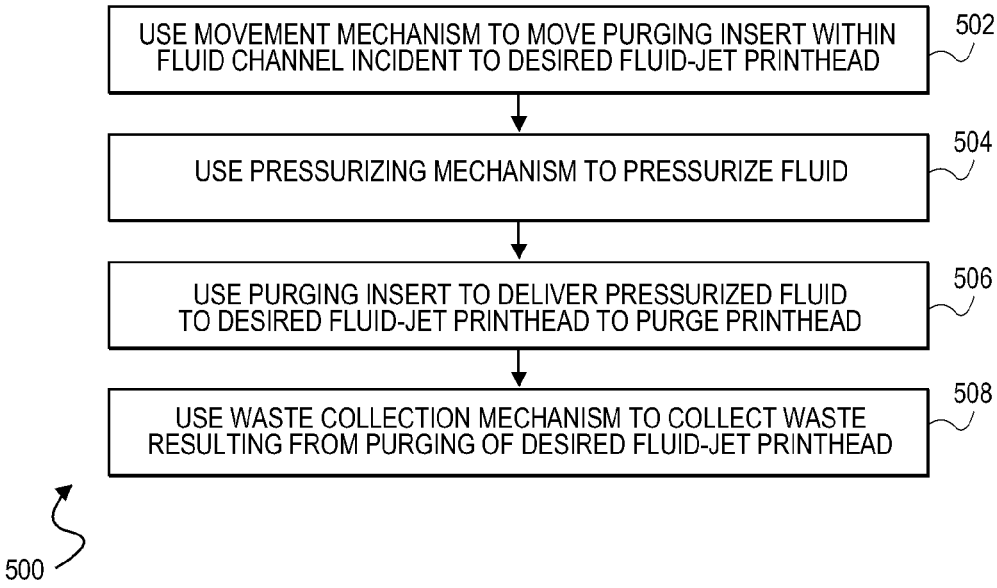
FIG. 5 is a flowchart of a method of use of a selective purging component or apparatus, according to an embodiment of the present disclosure.

In conclusion, FIG. 5 shows a method 500 for using the selective purging component 202, according to an embodiment of the disclosure. The movement mechanism 206 is used to move the purging insert 204 within the fluid channel 108 to a desired fluid-jet printhead (502). This may be achieved as has been described in relation to FIGS. 3A and 3B, or as has been described in relation to FIGS. 4A and 4B, for instance. The pressurizing mechanism 208 is then used to pressurize fluid (504). This may also be achieved as has been described in relation to FIGS. 3A and 3B, or as has been described in relation to FIGS. 4A and 4B, for instance.

The purging insert 204 is thereafter used to deliver the pressurized fluid to the desired fluid-jet printhead to purge this printhead (506). Again, this may be achieved in relation to FIGS. 3A and 3B, or as has been described in relation to FIGS. 4A and 4B, for instance. In some embodiments, the waste collection mechanism 210 can be used to collect the waste resulting from purging of the desired fluid-jet printhead (508), as has been specifically described in detail in relation to FIGS. 3A and 3B, but which may also be employed in relation to the embodiment described in relation to FIGS. 4A and 4B above.

We claim:

1. An apparatus to selectively purge a desired fluid-jet printhead of a plurality of fluid jet printheads of a page-wide array fluid jet device, comprising:

a purging insert completely and movably locatable within a fluid channel of the page-wide array fluid jet device, the fluid channel to supply fluid to the fluid jet printheads during normal operation of the page-wide array fluid jet device in which the fluid is selectively ejected from the fluid jet printheads in accordance with a desired image;

a movement mechanism operatively coupled to the purging insert to move the purging insert within the fluid channel incident to just the desired fluid jet printhead and not incident to the fluid jet printheads other than the desired fluid jet printhead; and, a pressurizing mechanism fluidically coupled to the purging insert to pressurize fluid, the purging insert to deliver the fluid as pressurized by the pressurizing mechanism to the desired fluid jet printhead to purge the desired fluid jet printhead.

2. The apparatus of claim 1, wherein the purging insert comprises a cavity, and the fluid channel is separated from the desired fluid jet printhead by a wall having a secondary channel fluidically coupling the fluid channel to the desired fluid jet printhead, wherein the movement mechanism is to move the purging insert within the fluid channel incident to the desired fluid jet printhead such that the cavity of the purging insert is fluidically coupled to the desired fluid jet printhead via the secondary channel.

3. The apparatus of claim 1, wherein the movement mechanism comprises:

a carriage section movably disposed on an exterior of the fluid channel;

a ferromagnetic member movably disposed within the fluid channel incident to the carriage section and attached to the purging insert; and, a direct current (DC) coil wound around the carriage section, the DC coil inductively coupled to the ferromagnetic member upon powering of the DC coil such that movement of the carriage section over the exterior of the fluid channel is to cause corresponding movement of the purging insert within the fluid channel.

4. The apparatus of claim 3, wherein the movement mechanism further comprises a motor to move the carriage section over the exterior of the fluid channel.

5. The apparatus of claim 1, wherein the pressurizing mechanism is disposed within the insert and comprises:

a cavity;

one or more inlet valves fluidically coupling the fluid channel with the cavity to move fluid from the fluid channel to the cavity;

a piston to pressurize the fluid within the cavity; and, an outlet valve fluidically coupling the cavity to the desired fluid-jet printhead to move the fluid as pressurized by the piston within the cavity to the desired fluid jet printhead.

6. The apparatus of claim 5, wherein the pressurizing mechanism further comprises:

a carriage section movably disposed on an exterior of the fluid channel; and, an alternating current (AC) coil wound around the carriage section, the AC coil electromagnetically coupled to the piston upon powering of the AC coil such that the piston is caused to oscillate within the cavity to pressurize the fluid within the cavity.

7. The apparatus of claim 1, further comprising a waste collection mechanism movably disposed over an exterior of the fluid channel to collect waste resulting from purging of the desired fluid jet printhead, wherein the movement mechanism is further operatively coupled to the waste collection mechanism to move the waste collection mechanism over the exterior of the fluid channel incident to the desired fluid jet printhead.

8. The apparatus of claim 1, wherein the movement mechanism comprises:

one or more rotatable pulley wheels; and, a flexible hollow tubing disposed around the rotatable pulley wheels and fixably attached to and fluidically coupled to the purging insert within the fluid channel, wherein rotation of the rotatable pulley wheels is to cause movement of the flexible hollow tubing disposed around the rotatable pulley wheels to result in movement of the purging insert within the fluid channel.

9. The apparatus of claim 8, wherein the movement mechanism further comprises a motor to rotate at least one of the rotatable pulley wheels.

10. The apparatus of claim 1, wherein the pressurizing mechanism comprises:

a pump to pressurize the fluid; and, a flexible hollow tubing fluidically coupling the pump and the purging insert within the fluid channel to deliver the fluid as pressurized from the pump to the purging insert.

11. A page-wide-array fluid jet device comprising:

a plurality of fluid jet printheads organized in a page-wide array at least substantially perpendicular to a direction of movement of media within the fluid-jet device;

a fluid channel to supply fluid to the fluid-jet printheads during normal operation of the fluid jet device; and, a purging component to selectively purge a desired fluid-jet printhead of the fluid jet printheads, comprising:

a purging insert movably locatable within the fluid channel;

a movement mechanism operatively coupled to the purging insert to move the purging insert within the fluid channel incident to the desired fluid-jet printhead; and, a pressurizing mechanism fluidically coupled to the purging insert to pressurize fluid, the purging insert to deliver the fluid as pressurized by the pressurizing mechanism to the desired fluid jet printhead to purge the desired fluid jet printhead.

12. The fluid jet device of claim 11, wherein the purging insert comprises a cavity, and the fluid channel is separated from the desired fluid jet printhead by a wall having a secondary channel fluidically coupling the fluid channel to the desired fluid jet printhead, wherein the movement mechanism is to move the purging insert within the fluid channel incident to the desired fluid jet printhead such that the cavity of the purging insert is fluidically coupled to the desired fluid jet printhead via the secondary channel.

13. The fluid jet device of claim 11, wherein the movement mechanism comprises:

a first carriage section movably disposed on an exterior of the fluid channel;

a ferromagnetic member movably disposed within the fluid channel incident to the first carriage section and attached to the purging insert; and, a direct current (DC) coil wound around the first carriage section, the DC coil inductively coupled to the ferromagnetic member upon powering of the DC coil such that movement of the first carriage section over the exterior of the fluid channel is to cause corresponding movement of the purging insert within the fluid channel, and wherein the pressurizing mechanism is disposed within the insert and comprises:

a cavity;

one or more inlet valves fluidically coupling the fluid channel with the cavity to move fluid from the fluid channel to the cavity;

a piston to pressurize the fluid within the cavity;

an outlet valve fluidically coupling the cavity to the desired fluid-jet printhead to move the fluid as pressurized by the piston within the cavity to the desired fluid jet printhead;

a second carriage section movably disposed on an exterior of the fluid channel; and, an alternating current (AC) coil wound around the second carriage section, the AC coil electromagnetically coupled to the piston upon powering of the AC coil such that the piston is caused to oscillate within the cavity to pressurize the fluid within the cavity.

14. The fluid jet device of claim 11, wherein the movement mechanism comprises:

one or more rotatable pulley wheels; and, a first flexible hollow tubing disposed around the rotatable pulley wheels and fixably attached to and fluidically coupled to the purging insert within the fluid channel, where rotation of the rotatable pulley wheels is to cause movement of the first flexible hollow tubing disposed around the rotatable pulley wheels to result in movement of the purging insert within the fluid channel, and wherein the pressurizing mechanism comprises:

a pump to pressurize the fluid; and, a second flexible hollow tubing fluidically coupling the pump and the first flexible hollow tubing to deliver the fluid as pressurized from the pump to the purging insert.

15. A method for selectively purging a desired fluid-jet printhead of a plurality of fluid jet printheads of a page-wide array fluid jet device, comprising:

using a movement mechanism operatively coupled to a purging insert completely and movably locatable within a fluid channel of the page-wide array fluid jet device to move the purging insert within the fluid channel incident to just the desired fluid jet printhead and not incident to the fluid jet printheads other than the desired fluid jet printhead, the fluid channel to supply fluid to the fluid jet printheads during normal operation of the page-wide array fluid-jet device in which the fluid is selectively ejected from the fluid jet printheads in accordance with an image;

using a pressurizing mechanism fluidically coupled to the purging insert to pressurize fluid; and, using the purging insert to deliver the fluid as pressurized to the desired fluid jet printhead to purge the desired fluid jet printhead.

* * * * *

UNITED STATES PATENT AND TRADEMARK OFFICE

CERTIFICATE OF CORRECTION

PATENT NO. : 8,157,361 B2
APPLICATION NO. : 12/348304
DATED : April 17, 2012
INVENTOR(S) : Chen Turkenitz et al.

It is certified that error appears in the above-identified patent and that said Letters Patent is hereby corrected as shown below:

In column 9, line 8, in Claim 1, delete "fluid jet" and insert -- fluid-jet --, therefor.

In column 9, line 9, in Claim 1, delete "fluid jet" and insert -- fluid-jet --, therefor.

In column 9, line 11, in Claim 1, delete "fluid jet" and insert -- fluid-jet --, therefor.

In column 9, line 12, in Claim 1, delete "fluid jet" and insert -- fluid-jet --, therefor.

In column 9, line 13, in Claim 1, delete "fluid jet" and insert -- fluid-jet --, therefor.

In column 9, line 15, in Claim 1, delete "fluid jet" and insert -- fluid-jet --, therefor.

In column 9, line 18, in Claim 1, delete "fluid jet" and insert -- fluid-jet --, therefor.

In column 9, line 19, in Claim 1, delete "fluid jet" and insert -- fluid-jet --, therefor.

In column 9, line 20, in Claim 1, delete "fluid jet" and insert -- fluid-jet --, therefor.

In column 9, line 24, in Claim 1, delete "fluid jet" and insert -- fluid-jet --, therefor.

In column 9, lines 24-25, in Claim 1, delete "fluid jet" and insert -- fluid-jet --, therefor.

In column 9, line 28, in Claim 2, delete "'fluid jet" and insert -- fluid-jet -- therefor.

In column 9, lines 29-30, in Claim 2, delete "fluid jet'" and insert -- fluid-jet --, therefor.

In column 9, line 33, in Claim 2, delete "fluid jet" and insert -- fluid-jet --, therefor.

In column 9, line 34, in Claim 2, delete "fluid jet" and insert -- fluid-jet --, therefor.

Signed and Sealed this
Twenty-seventh Day of November, 2012

David J. Kappos

David J. Kappos
*Director of the United States Patent and Trademark Office*

In column 9, line 61, in Claim 5, delete “fluid jet” and insert -- fluid-jet --, therefor.

In column 10, line 7, in Claim 7, delete “fluid jet” and insert -- fluid-jet --, therefor.

In column 10, line 11, in Claim 7, delete “fluid jet” and insert -- fluid-jet --, therefor.

In column 10, line 32, in Claim 11, delete “fluid jet” and insert -- fluid-jet --, therefor.

In column 10, line 33, in Claim 11, delete “fluid jet” and insert -- fluid-jet --, therefor.

In column 10, line 37, in Claim 11, delete “fluid jet” and insert -- fluid-jet --, therefor.

In column 10, line 39, in Claim 11, delete “fluid jet” and insert -- fluid-jet --, therefor.

In column 10, line 49, in Claim 11, delete “fluid jet” and insert -- fluid-jet --, therefor.

In column 10, line 50, in Claim 11, delete “fluid jet” and insert -- fluid-jet --, therefor.

In column 10, line 51, in Claim 12, delete “fluid jet” and insert -- fluid-jet --, therefor.

In column 10, line 53, in Claim 12, delete “fluid jet” and insert -- fluid-jet --, therefor.

In column 10, line 55, in Claim 12, delete “fluid jet” and insert -- fluid-jet --, therefor.

In column 10, line 58, in Claim 12, delete “fluid jet” and insert -- fluid-jet --, therefor.

In column 10, line 59, in Claim 12, delete “fluid jet” and insert -- fluid-jet --, therefor.

In column 10, line 61, in Claim 13, delete “fluid jet” and insert -- fluid-jet --, therefor.

In column 11, line 18, in Claim 13, delete “fluid jet” and insert -- fluid-jet --, therefor.

In column 11, line 26, in Claim 14, delete “fluid jet” and insert -- fluid-jet --, therefor.

In column 12, line 1, in Claim 14, delete “where” and insert -- wherein --, therefor.

In column 12, line 12, in Claim 15, delete “fluid jet” and insert -- fluid-jet --, therefor.

In column 12, line 13, in Claim 15, delete “fluid jet” and insert -- fluid-jet --, therefor.

In column 12, line 16, in Claim 15, delete “fluid jet” and insert -- fluid-jet --, therefor.

In column 12, line 18, in Claim 15, delete “fluid jet” and insert -- fluid-jet --, therefor.

In column 12, line 19, in Claim 15, after “the” delete “fluid jet” and insert -- fluid-jet --, therefor.

In column 12, line 19, in Claim 15, after “desired” delete “fluid jet” and insert -- fluid-jet --, therefor.

In column 12, line 20, in Claim 15, delete “fluid jet” and insert -- fluid-jet --, therefor.

In column 12, line 23, in Claim 15, delete “fluid jet” and insert -- fluid-jet --, therefor.

In column 12, line 28, in Claim 15, delete “fluid jet” and insert -- fluid-jet --, therefor.

In column 12, lines 28-29, in Claim 15, delete “fluid jet” and insert -- fluid-jet --, therefor.